US009428877B2

(12) United States Patent
Clifton

(10) Patent No.: US 9,428,877 B2
(45) Date of Patent: Aug. 30, 2016

(54) MODULAR MONOPOLE TOWER FOUNDATION

(71) Applicant: ARE Telecom Incorporated, St. Paul, MN (US)

(72) Inventor: Michael Clifton, Flagstaff, AZ (US)

(73) Assignee: ARE Telecom Incorporated, St. Paul, MN (US)

( * ) Notice: Subject to any disclaimer, the term of this patent is extended or adjusted under 35 U.S.C. 154(b) by 0 days.

(21) Appl. No.: 14/845,545

(22) Filed: Sep. 4, 2015

(65) Prior Publication Data

US 2015/0376857 A1 Dec. 31, 2015

Related U.S. Application Data

(63) Continuation of application No. PCT/US2014/037243, filed on May 8, 2014.

(60) Provisional application No. 61/821,977, filed on May 10, 2013.

(51) Int. Cl.

| | |
|---|---|
| ***E02D 27/00*** | (2006.01) |
| ***E02D 27/42*** | (2006.01) |
| ***E04H 12/22*** | (2006.01) |

(52) U.S. Cl.

CPC ..... *E02D 27/42* (2013.01); *E04H 12/2238* (2013.01)

(58) Field of Classification Search

CPC ..... E02D 27/52; E02D 27/42; Y02B 10/30; Y02E 10/728; F05B 2240/912; F05B 2240/913

See application file for complete search history.

(56) References Cited

U.S. PATENT DOCUMENTS

| | | | | |
|---|---|---|---|---|
| 3,119,588 A * | 1/1964 | Keats | E01F 9/012 116/173 |
| 5,531,419 A * | 7/1996 | Gustafsson | E04H 12/187 248/519 |
| 6,655,097 B1 * | 12/2003 | Poolaw | E04H 12/20 248/188.1 |
| 8,220,213 B2 * | 7/2012 | Jolly | E02D 27/42 52/292 |

(Continued)

OTHER PUBLICATIONS

Chinese Office Action and English translation dated Apr. 27, 2016 for corresponding Chinese Application No. 201490000869.X, filed Jan. 6, 2016.

*Primary Examiner* — Brian Mattei
*Assistant Examiner* — Gisele Ford
(74) *Attorney, Agent, or Firm* — Peter J. Ims; Westman, Champlin & Koehler, P.A.

(57) ABSTRACT

A portable and modular foundation that can be utilized to support a monopole includes a central hub and a plurality of legs. A proximal end of each leg is removably attached to the central hub. A plurality of floor panels extends from proximate the hub to a perimeter of the foundation and define a substantially uninterrupted floor. With the plurality of floor panels attached to the legs, the foundation can optionally be buried where the soil or other material is positioned on top of the floor panels to provide the necessary ballast to allow the foundation to retain a monopole with a piece of equipment in an elevated position. Alternatively, if the foundation is to be utilized above ground, a plurality of wall panels can be attached to the floor panels and the legs with braces to retain the wall panels in a substantially vertical position. The plurality of wall panels forms a substantially continuous wall about a perimeter of foundation such that ballast can be placed therein.

20 Claims, 6 Drawing Sheets

(56) References Cited

U.S. PATENT DOCUMENTS 8,833,004 B2 * 9/2014 Prass ..... E02D 27/425 52/169.1
2002/0194794 A1 * 12/2002 Hill ..... E04H 12/2292 52/40
2004/0226236 A1 * 11/2004 Pidgeon ..... E02D 27/01 52/236.2
2007/0181767 A1 * 8/2007 Wobben ..... E02D 27/42 248/346.01
2008/0072511 A1 * 3/2008 Phuly ..... E02D 27/42 52/294
2008/0236073 A1 * 10/2008 Bagepalli ..... F03D 1/005 52/292
2010/0043318 A1 * 2/2010 Armbrecht ..... F03D 11/045 52/173.1
2011/0037264 A1 * 2/2011 Roddier ..... B63B 35/44 290/44
2011/0061321 A1 * 3/2011 Phuly ..... F03D 11/045 52/297
2011/0131896 A1 * 6/2011 Hansen ..... E04B 1/24 52/167.3
2012/0047830 A1 * 3/2012 Phuly ..... F03D 11/045 52/294
2012/0167499 A1 * 7/2012 Knisel ..... F03D 11/045 52/231
2012/0228442 A1 * 9/2012 Clifton ..... H02S 20/00 248/163.1

* cited by examiner

MODULAR MONOPOLE TOWER FOUNDATION

CROSS-REFERENCE TO RELATED APPLICATION

This Application is a Continuation of International Application No. PCT/US2014/37243, filed May 8, 2014, and published as WO2014/182871 on Nov. 13, 2014, in English, which claims priority of the U.S. Application No. 62/821,977, filed on May 10, 2013, the contents of which are hereby incorporated by reference in their entirety.

FIELD OF THE DISCLOSURE

The present invention relates to a foundation and raising system for a monopole tower. More particularly, the present invention relates to a portable, modular foundation and raising system that can be stored and transported in a compact, disassembled state and assembled on site. The monopole tower is capable of supporting one of a number of pieces of equipment including, but not limited to, wind turbines, solar panels, street lights, communication devices and monitoring systems.

BACKGROUND

Monopoles towers are becoming increasingly utilized in numerous industries including, for instance, renewable wind energy and solar energy and also in the satellite and wireless communication industries. Monopole towers provide the necessary structural support to maintain a wind turbine, solar panels or antennae in an elevated position while reducing capital expenditures necessary for a typical support structure. Monopoles can also be utilized to support meteorological equipment such as an anemometer, wind direction vanes, temperature sensors and pressure sensors. Monopoles can also be utilized to support street lights or any other industry where an elevated lighting source can be utilized, such as the construction industry.

Typically, monopoles are secured to concrete foundations having footings buried into the ground. Concrete foundations are typically expensive to construct and often times require a construction permit. Once constructed, the foundation cannot be moved. Therefore, if a location for a monopole is abandoned or becomes obsolete, the foundation is either removed or abandoned at the location. In the event that the location is abandoned, the foundation can become a potential hazard.

Further, typical monopole foundations do not provide the capability to raise and lower the monopole and the attached equipment. Having the capability to easily raise and lower the monopole allows access to the equipment at ground level to repair or maintain the equipment. The capability to raise and lower the monopole also allows the owner or operator to protect the equipment secured to the top of a monopole from damage during violent weather. For instance, if a wind turbine secured to a top of a monopole when left raised in the elevated position during a storm having high wind loads, then the wind turbine or the monopole or both could be damaged.

SUMMARY

The present disclosure includes a portable and modular foundation that can be utilized to support a monopole. The foundation includes a central hub and a plurality of legs. A proximal end of each leg is removably attached to the central hub. A plurality of floor panels extends from proximate the hub to a perimeter of the foundation and define a substantially uninterrupted floor. With the plurality of floor panels attached to the legs, the foundation can optionally be buried where the soil or other material is positioned on top of the floor panels to provide the necessary ballast to allow the foundation to retain a monopole with a piece of equipment in an elevated position. Alternatively, if the foundation is to be utilized above ground, a plurality of wall panels can be attached to the floor panels and the legs with braces to retain the walls in a substantially vertical position. The plurality of wall panels forms a substantially continuous wall about a perimeter of foundation. The plurality of wall panels define a volume into which ballast can be placed to provide the necessary stability to the foundation to retain a monopole with equipment attached thereto in an elevated position. The present invention also includes a lifting mechanism that attaches to both the modular portable foundation and the monopole to raise and lower the monopole and the attached equipment.

DETAILED DESCRIPTION

Figure 1:
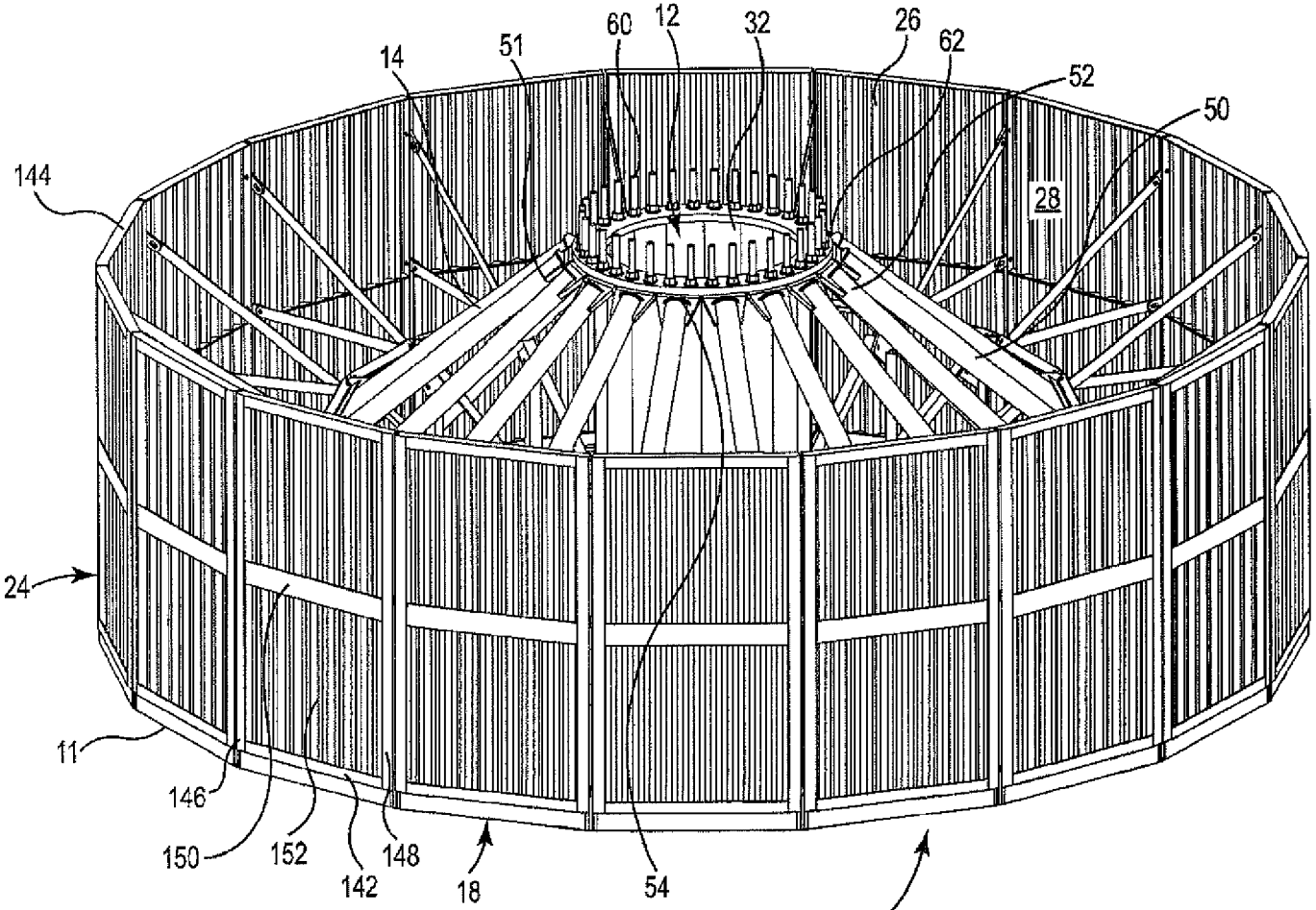
FIG. 1 is a perspective view of a portable and modular monopole foundation.
Figure 2:
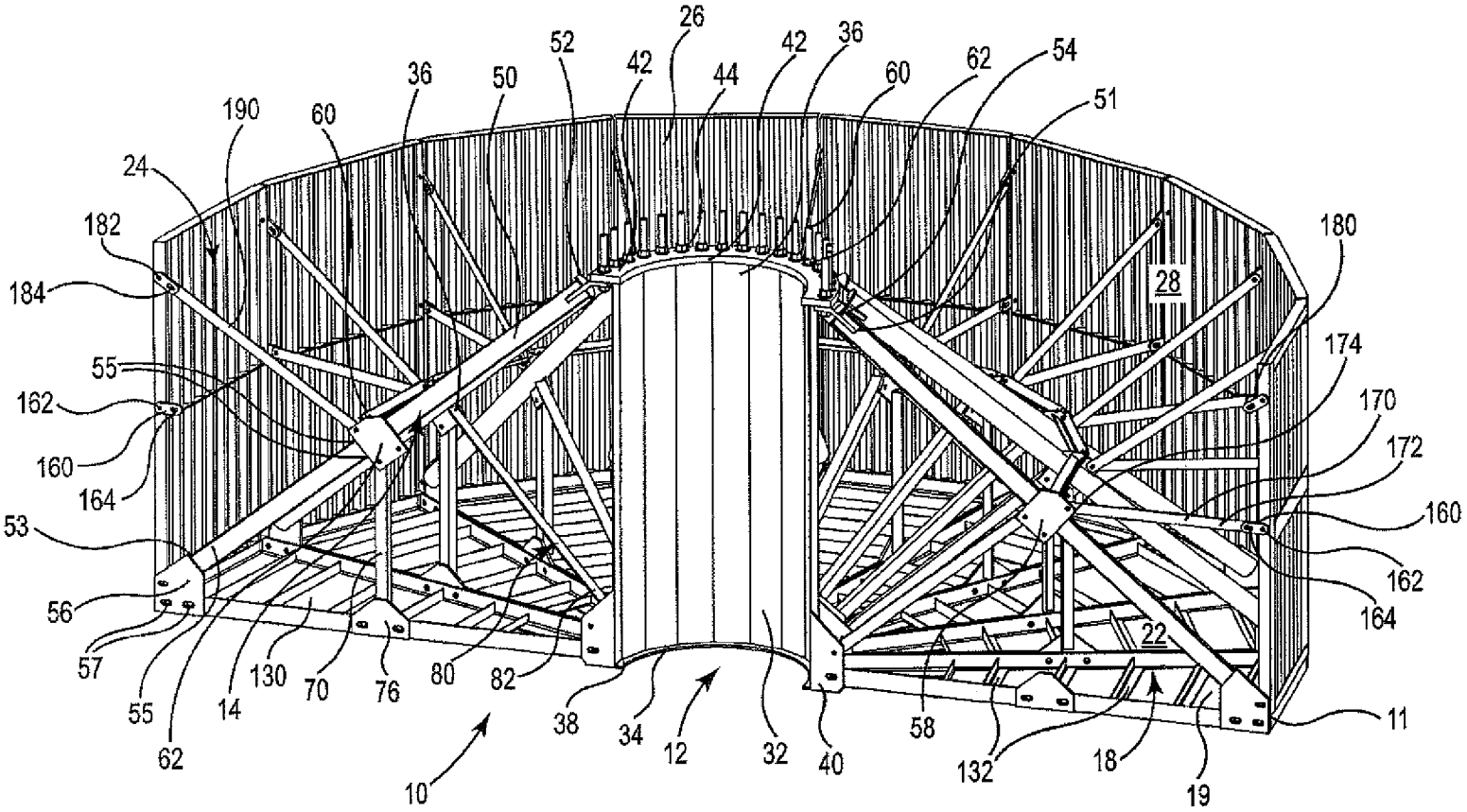
FIG. 2 is a sectional view of the portable and modular monopole foundation.

A portable and modular foundation is generally illustrated in FIGS. 1 and 2 at 10. The foundation 10 includes a central hub 12 and a plurality of spaced apart legs 14 that are removably attached to the central hub 12 proximate a proximal end 16. A plurality of floor panels 18 are secured to the plurality of the legs 14 and to the central hub 12 where the plurality of floor panels 18 when secured to the plurality of legs 14 and the central hub 12 to form a substantially continuous floor 22. The substantially continuous floor 22 accepts ballast from proximate the central hub 12 to a perimeter 11 of the foundation 10. Optionally, a plurality of wall panels 24 can be removably secured to the plurality of floor panels 18 and to the plurality of legs 14 to form a substantially continuous wall 26 which defines a volume 28 into which ballast can be placed to provide the necessary stability to raise and lower a monopole with a piece of equipment attached thereto.

Once assembled, the foundation 10 can be buried into the ground to provide the necessary ballast to raise and lower a monopole with the attached equipment and also withstand the torque developed by a wind load. In the event the foundation 10 is buried, the plurality of wall panels 24 are not necessary to retain the ballast on the foundation 10.

However, because the floor panels 18 for the substantially continuous floor 22 and the wall panels 24 form a substantially continuous wall 26, the foundation can also be utilized above ground. The volume 28 defined by the substantially continuous floor 22 and the substantially continuous wall 26 accepts sufficient ballast such that the ballast provides the necessary stability to raise and lower a monopole with equipment attached thereto while also being capable of withstanding the torque created by a wind load on the elevated equipment and the monopole. Therefore, the foundation 10 can be utilized either above ground or buried below grade.

The foundation 10, being a modular construction can be stored and transported in a disassembled, compact state to a desired location for a monopole and associated equipment. Each leg 14 includes a plurality of components that can be transported in a disassembled, compact configuration. Each of the plurality of floor panels 18 can also be transported as separate components that can stack one on top of the other to conserve space. Each of the plurality of wall panels 24 are also transported as separate components that can be stacked on top of each other. The plurality of legs 14, the plurality of floor panels 18, the plurality of wall panels 24 and the central hub 12 can be assembled and secured together using bolts and nuts at the site thereby allowing the foundation 10 to be assembled utilizing typically available tools such as wrenches and ratchets with sockets. Because the foundation 10 can be assembled on site, the disassembled foundation 10 can be transported to remote locations in the compact, disassembled state relative to a foundation that is pre-assembled. Additionally, if the location of the foundation 10 and monopole with the equipment becomes undesirable, the monopole and the associated equipment can be lowered and removed from the foundation 10 and the foundation 10 can be disassembled for transport from the site by removing the nuts from the bolts.

Referring to FIGS. 1-5, the central hub 12 includes a pipe 32 having a lower end 34 and an upper end 36. A lower flange 38 is attached to the lower end 34 and a plurality of substantially uniformly spaced apart vertical braces 40 are fixedly attached to the outer surface of the pipe 32 and the lower flange 38. A component of each the plurality of legs 14 is removably attached to one of the braces 40 with bolts and nuts.

An upper flange 42 is fixedly attached to the upper end 36 of the pipe 32 where a proximal end 52 of a main member 50 of each of the plurality of legs 14 is secured to the upper flange 42. The proximal end 52 of the main member 50 includes a upper mounting bracket 54 having through bores 56 that align with apertures 44 of a plurality of apertures 46 that are substantially uniformly spaced about the upper flange 42. Bolts 60 are inserted through the through bores 56 and the apertures 44. Nuts 62 threadably engage the bolts 60 to frictionally secure the upper mounting bracket 54 to the upper flange 42. As the bolts 60 extend upwardly from the upper flange 42, the bolts 60 are also utilized to secure a monopole to the foundation 10.

The lower flange 38, the upper flange 42 and the plurality of spaced apart vertical braces 40 are typically permanently attached to the pipe 32, typically with a weld. However a modular construction of the central hub 12 is also contemplated.

Referring to FIGS. 2-5, each of the plurality of legs 14 has the same or similar construction and therefore only one leg 14 will be described in detail. Each of the legs 14 has a modular design where the individual components of the legs 14 can be assembled and disassembled on site.

Each leg 14 includes the main member 50 having the upper mounting bracket 54 which is removably attached to the upper flange 42 of the central hub 12 with the bolts 60 and nuts 62. The main member 50 angles downwardly such that a distal end 55 is to proximate a perimeter 11 of the foundation 10. The distal end 54 includes a distal mounting bracket 56 that is fixedly attached thereto.

A distal end 19 of adjacent floor panels 18 are attached to the distal mounting bracket 56 by aligning apertures in the adjacent floor panels 18 with through bores in the distal mounting bracket 56. The through bores 51 in the distal mounting bracket 56 are typically elongated slots which allows for flexibility when assembling the foundation 10. Bolts are inserted through the aligned apertures 21 and through bores 57 and nuts threadably engage the bolts to secure the distal ends 19 of the adjacent floor panels together.

A middle mounting bracket 58 is attached to the main member 50 between the proximal end 52 and the distal end 55. The middle mounting bracket 58 includes an upper portion 60 that extends upwardly from the main member 50 and a lower portion 62 that extends downwardly from the main member 50. The upper and lower portions 60 and 62 include through bores for attaching additional bracing members of the legs 14 to the main member 50.

The lower portion 60 includes a bottom through bore that aligns with an aperture proximate an upper end 72 of a vertical brace member 70. A bolt is inserted through the aligned through bore and aperture and a nut threadably engages the bolt to secure the vertical brace member to the lower portion 62 of the middle brace 58.

A distal end 74 of the vertical brace member 70 includes a mounting bracket 76 fixedly attached thereto and having left and right elongated through bores that align with apertures in adjacent floor panels. Bolts are inserted through the aligned apertures in the floor panels 18 and the through bores in the mounting bracket 26 to secure the middle portions of the adjacent floor panels 18 to the vertical brace member 70. Securing the middle portions of the adjacent floor panels 18 together assists in retaining the floor panels 18 in the selected position.

Each leg 14 includes an upwardly slanting brace 80 where a through bore proximate a proximal end 82 aligns with an aperture 44 in vertical brace 40 on the central hub 12. A bolt is inserted through the through bore 51 and the aperture 44 and is secured therein with a nut.

A distal end 86 of the upwardly slanting brace 80 includes a through bore that aligns with an upper aperture 44 in the lower portion 62. Bolts and nuts are utilized to secure the distal end 86 of the upwardly slanted brace 80 to the lower portion 62 of the middle mounting bracket 58 attached to the main member 50.

The upwardly slanting brace 80 and the vertical brace member 70 provide additional support to the main member 50 such that the legs 14 are able to withstand the forces created by the ballast as well as the forces and torque imparted on the legs 14 as the monopole and equipment is raised and lowered as well as withstanding wind loadings.

The main member 50 is typically constructed of a metal pipe. A slot 51 in the proximal end accepts the proximal mounting bracket 42 and a slot 55 in the distal end accepts the distal mounting bracket 56. Aligned slots 55 in the middle portion of the main member 50 accept the middle mounting bracket 60. By utilizing slots 51, 53, 55, the mounting brackets 42, 56 and 60, all respectively, can be made of a unitary piece of material, such as steel, which increases the strength of the brackets, and therefore the legs 14. The engagement of the brackets with the slots also provides a stronger connection of the brackets to the main member when compared to attaching the brackets only to an exterior of the main member.

Figure 3:
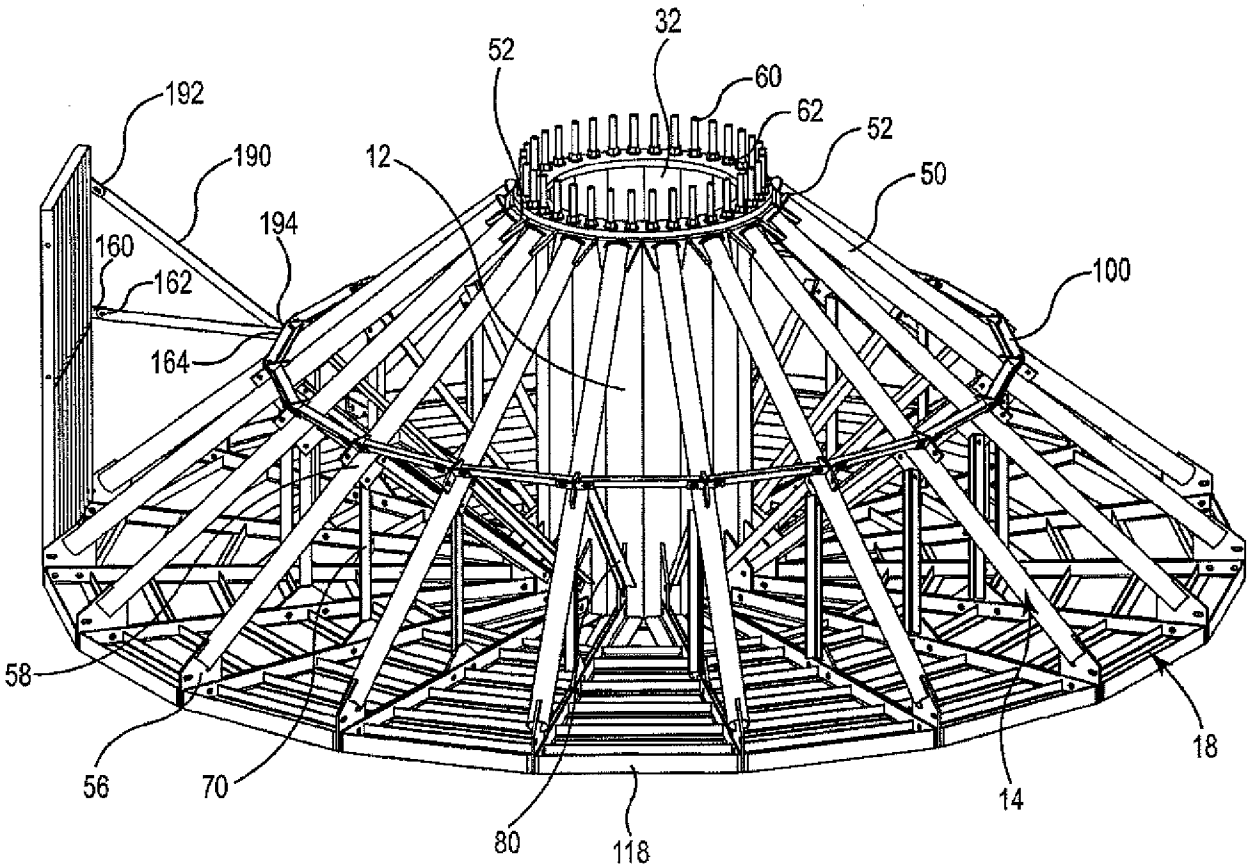
FIG. 3 is a perspective view of a portable and modular monopole foundation with a single wall panel attached thereto.
Figure 4:
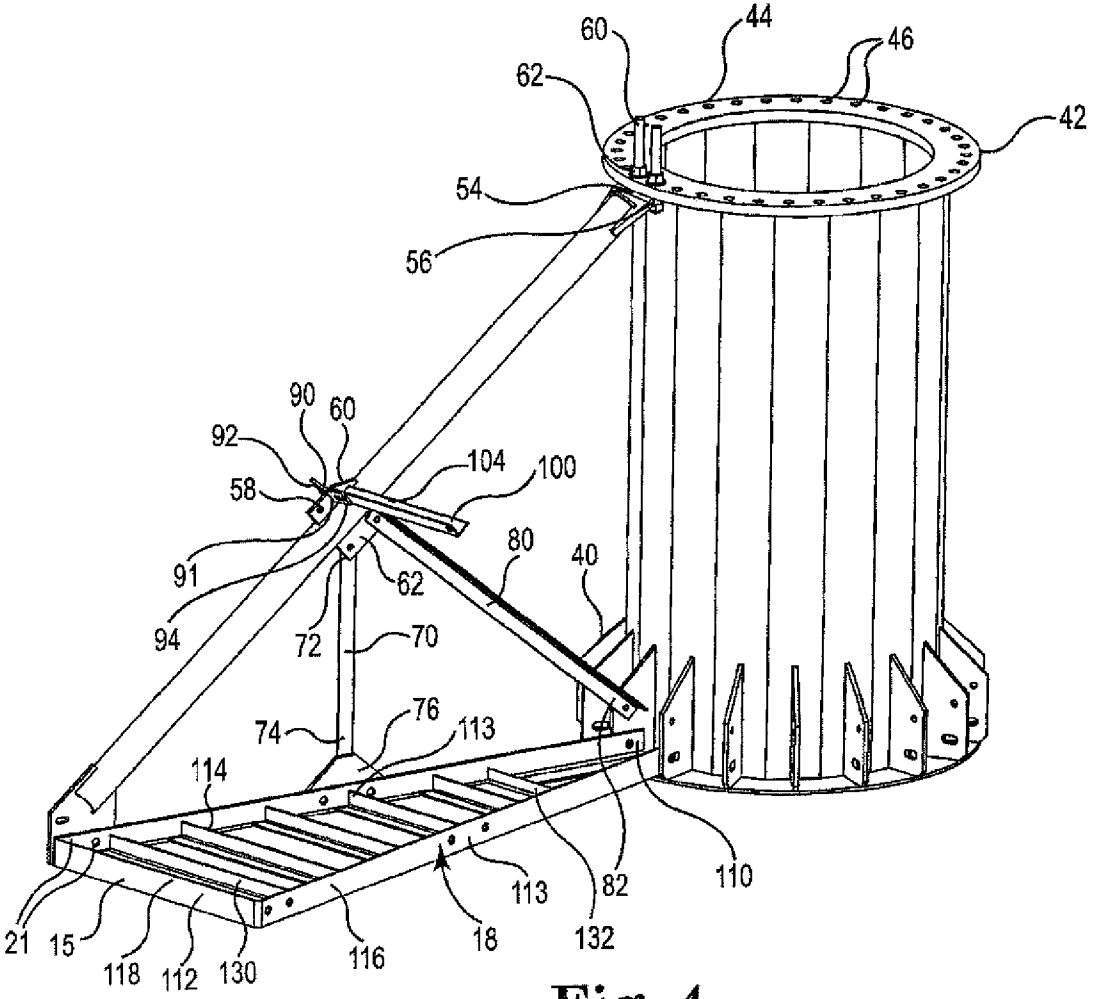
FIG. 4 is a perspective view of a central hub and a single leg and floor panel attached thereto.
Figure 5:
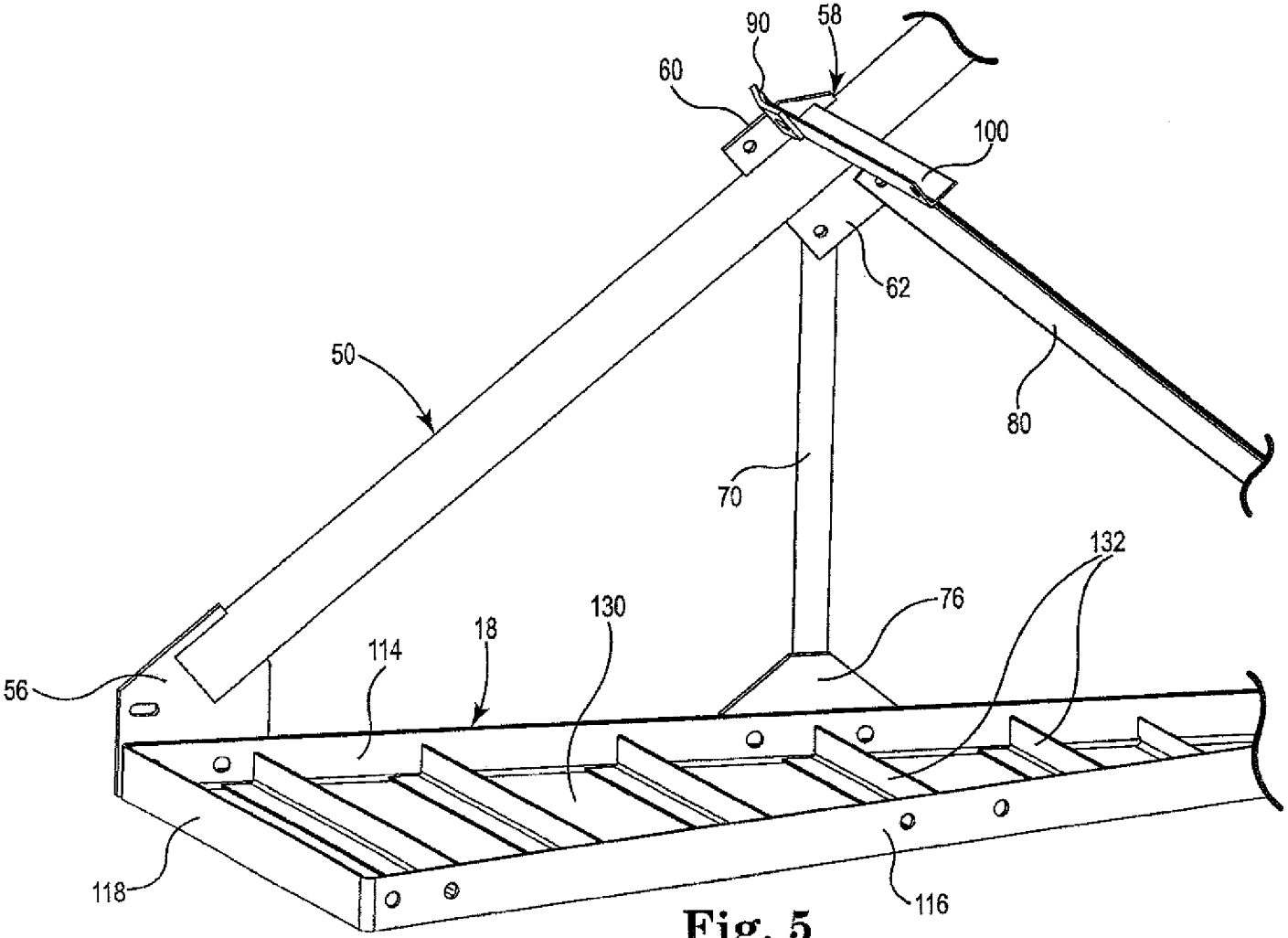
FIG. 5 is enlarged view of a distal end of the leg and floor panel.
Figure 6:
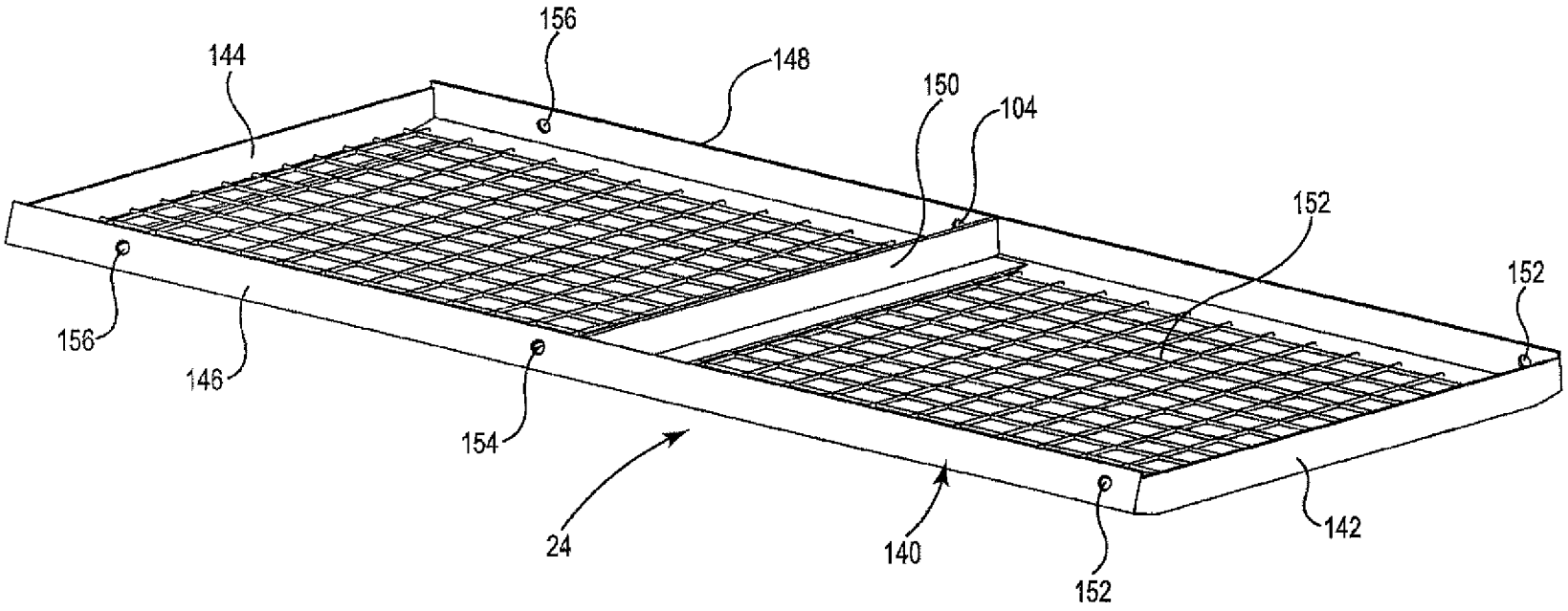
FIG. 6 is a perspective view of a wall panel.

Referring to FIGS. 3 and 4, a horizontal connecting member 90 is secured to the upper portion of the middle mounting bracket 60. The horizontal connecting member 90 is positioned within a slot 91 that is perpendicular to the main member 50. The horizontal connecting member 90 is secured to the middle mounting bracket with a weld. Left and right apertures proximate left and right ends 92 and 94 of the horizontal connecting member 90 align with apertures 102 proximate ends 104 of a horizontal braces 100. Bolts and nuts are used to secure the horizontal braces 100 to the horizontal connecting members 90 such that a horizontal ring is formed between the hub 12 and the perimeter. The horizontal braces 100 provide lateral stability to the legs 14 by interconnecting the adjacent legs 14 to each other.

Referring to FIGS. 1-5, each of the plurality of floor panels 18 has the same or similar construction and therefore only one floor panel 18 will be described in detail. Each of the floor panels 18 has a substantially wedge configuration where the floor panel has a narrow proximal end 110 and a wider distal end 112. The proximal end 110 is sized to fit between two adjacent vertical brace 40 on the hub 12 and also to rest upon the lower flange 38.

The floor panel 18 includes left and right side walls 114 and 116 that extend from the proximal end 110 to the distal end 120. The left and right side walls 114 and 116 are connected with a back wall 118 that forms a portion of the perimeter 11 of the foundation 10. The left and right side walls 114 and 116 have through bores 120 that align with apertures 39 in the vertical braces 40. When two floor panels 18 are positioned adjacent to each other, the through bores align with the aperture such that the proximal ends 110 of the adjacent floor panels 18 are secured to the hub 12 through the vertical brace 40 and to each other with bolts and nuts.

The left and right side walls 114 and 116 include a plurality of through bores and located proximate the distal end 112 and a middle portion 113, respectively. When the floor panels 18 are positioned proximate each other, the through bores align with through bores 51 in the distal mounting bracket 56. Bolts are inserted through the aligned through bores and the through bores in the distal mounting bracket 56 to secure the distal ends 112 of the adjacent floor members 18 together and also to the distal end of the leg 14 through the distal mounting bracket 56.

The through bores of the adjacent middle portions 113 of the floor panels 18 also align with apertures in the vertical mounting bracket 76. Bolts are inserted through the aligned through bores and secured together with nuts such that the middle portions 113 of the adjacent floor panels 18 are secured together and to the leg 14 at the vertical mounting bracket 76.

The left and right side walls 114 and 116 are typically constructed of angle iron where the horizontal portion of the angle iron is positioned towards an interior of the floor panel 18. The back wall 118 is also typically constructed of angle iron where the horizontal portion is positioned toward the interior of the floor panel 18. The horizontal portions provide a support upon which a floor panel 130 is positioned. The floor panel 130 is typically constructed from sheet metal or a metal plate and spans substantially the area defined by the left and right side walls 114 and 116, respectively, and the back wall 118. The floor panel 130 is typically fixedly attached to the left and right side walls 114 and 116, respectively, and the back wall 118, typically with a weld.

To provide additional structural strength, a plurality of pieces of angle iron 132 are spaced apart and secured to the floor panel 130 and the left and right side walls 114 and 116, respectively, typically with a weld.

With the plurality of legs 14 and the plurality of floor panels 18 assembled, the foundation 10 is capable of being buried to a selected depth where the upper flange 42 of the hub extends above grade. However, the foundation 10 can also be used as an above ground foundation 10 when sufficient ballast is placed on thereon.

Referring to FIGS. 1-3, and 6 to utilize the foundation 10 above ground, the plurality of wall panels 24 are removably secured to the legs 14 and the floor panels 18. The wall panels include a frame 140 constructed of angle iron which includes upper and lower frame members 142 and 144, respectively, that are connected with left and right frame members 146 and 148. The frame 140 includes a middle brace 150 that extends from the left frame member 146 to the right frame member 148.

A wall panel 152 is attached to the frame 140 to secure the wall panel 152 into the selected position. The wall panel 152 can be a corrugated metal as illustrated in FIGS. 1-3, or different sized meshes as illustrated FIG. 6. The type of wall panel 152 utilized is dependent upon the type of ballast contemplated for use, as the ballast should be prevented from leaking through the wall panel 152.

A length of the upper and lower frame members 142 and 144 are sized to be positioned between the left and right side walls 114 and 116 proximate the distal end of the floor panel 18. The lower frame member 142 is positioned proximate the back wall 118 where the vertical wall 118 prevents the lower frame member 142 from exiting the foundation.

The left and right frame members 146 and 148 include spaced apart lower, middle and upper apertures 152, 154 and 156, respectively that align when placed adjacent each other. The lower apertures 152 align with a through bore in the distal mounting bracket 56 and a bolt is inserted therethrough and secured with a nut to attach the lower portions of the adjacent wall panels 24 to each other and the leg 14.

A middle mounting bracket 160, having a distal aperture 162 and a proximal aperture 164, is positioned between adjacent wall panels 24 such that the distal aperture 162 is aligned with the middle apertures 154 of the adjacent wall panels 24. A bolt is inserted therethrough and secured in position with a nut to retain the middle portions the adjacent wall panels 24 together and to also support the middle mount bracket 160.

A substantially horizontal brace member 170 having apertures proximate opposing ends 172 and 174 is positioned to align the aperture 174 to the aperture 164 of the middle mounting bracket 160. A bolt is insert though the aligned apertures and retained with a nut to retain the substantially horizontal brace member 170 to the middle mount bracket 160.

The other end 174 of the substantially horizontal brace member 170 is attached to the upper portion 60 of the middle mounting bracket 56 by aligning the aperture proximate end 72 with an aperture and the upper portion 60 and inserting a bolt therethrough and retaining the bolt therein with a nut. The horizontal brace member 170 provides structural support to the wall panel proximate the middle of the panel 24 and aids in retaining the ballast within the volume 28 defined by the wall panels 24 and the floor panels 18.

A top mounting bracket 180, having a distal aperture 182 and a proximal aperture 184, is positioned between adjacent wall panels 24 such that the distal aperture 182 is aligned with the top apertures 156 of the adjacent wall panels 24. A bolt is inserted therethrough and secured in position with a nut to retain the top portions the adjacent wall panels 24 together and to also support the top mounting bracket 180.

An angled brace member 190 having apertures proximate opposing ends 192 and 194 is positioned to align the apertures of the top mounting bracket 190 with the aperture 182 of the mounting bracket 180. A bolt is insert though the aligned apertures and retained with a nut to retain the angled brace member 190 to the top mount bracket 180.

The other end 194 of the angled brace member 190 is attached to the upper portion 60 of the middle mounting bracket 58 by aligning apertures inserting a bolt therethrough and retaining the bolt therein with a nut. The angled brace member 190 provides structural support to the wall panel proximate the top of the panels 24 and aids in retaining the ballast within the volume 28 defined by the wall panels 24 and the floor panels 18.

A monopole is typically pivotally attached to the foundation with a pivot pin or hinge. The monopole includes a plate with elongated through bores that position about the bolts 60 when raised.

The monopole can be raised with a lifting mechanism that is attached to at least the monopole and optionally the foundation. Lifting mechanisms contemplated that are attached to the foundation 10 and the monopole include manual jacks, hydraulic rams, electric powered actuators.

Gin poles and a rigging system can also be utilized to raise the monopole. One type of gin pole is a horizontal gin pole that is attached substantially perpendicular to the monopole. The rigging system which can be secured to the foundation or apart from the foundation can be manipulated to cause the monopole to be raised and lowered using the rigging system and the mechanical advantage of the gin pole.

Another option is to secure the rigging or cable system to the monopole a selected distance up the monopole and utilizing a vertical gin pole with the rigging system to raise and lower the monopole and attached equipment.

Although the present invention has been described with reference to preferred embodiments, workers skilled in the art will recognize that changes may be made in form and detail without departing from the spirit and scope of the invention.

The invention claimed is:

1. A foundation for a monopole comprising:

a central hub;

a plurality of legs removably attached to the hub, each leg of the plurality of legs comprising a main member having a proximal leg end configured to be removably attached to the hub and wherein each of the legs of the plurality of legs having a distal leg end;

a plurality floor panels, wherein each of the floor panels of the plurality of floor panels having a proximal panel end and a distal panel end, the proximal panel end of each of the floor panels of the plurality of floor panels configured to be removably attached to the central hub and each of the distal panel ends are configured to be removably attached to a legs of the plurality of legs wherein the plurality of floor panels are configured to be positioned about the central hub to form a substantially continuous floor from a perimeter of the central hub to a distal perimeter defined by the distal panel ends of the plurality of panels; and a plurality of wall panels configured to engage the plurality of legs proximate the distal leg ends and the plurality of floor panels proximate the distal panel ends, wherein the plurality of wall panels are configured substantially continuous wall substantially concentric with the central hub.

2. The foundation of claim 1 and wherein the hub further comprises:

a section of pipe having an outer surface, a first end, a second end and a central axis passing through the first end and the second end; and a plurality of ribs attached to the pipe at substantially even intervals about the outer surface of the pipe and wherein the proximal leg end of each leg of the plurality of legs is configured to be removably attached to two adjacent ribs.

3. The foundation of claim 2 and wherein the hub further comprises:

an upper flange attached to the first end of the pipe wherein the upper flange comprises a plurality apertures about the flange substantially uniformly spaced apart; and a lower plate attached to the second end of the pipe wherein the lower plate is attached to each rib of the plurality of ribs.

4. The foundation of claim 3 and wherein each of the plurality of legs comprises:

a main member having a proximal end and a distal end wherein the proximal end is configured to be removably attached to the upper flange and the distal end is configured to removably attached to adjacent floor panels of the plurality of panels proximate a distal ends thereof; and a slanted support brace having a proximal end and a distal end wherein the proximal end is configured to be removably attached to one of the ribs and the distal end is configured to be removably attached to the main member between the proximal leg end and the distal leg end.

5. The foundation of claim 4 and wherein each leg of the plurality of legs further comprises an intermediate brace having a top end configured to be removably connected to the main member between the proximal leg end and the distal leg end and a bottom end configured to be removably connected to adjacent floor panels of the plurality of floor panels between the proximal and distal panel ends thereof.

6. The foundation of claim 4 and wherein the main member comprises:

a pipe having an interior cavity extending from the proximal end to the distal end;

a first pair of aligned slots proximate the proximate the proximal end;

a second pair of aligned slots proximate the distal end; and a third pair of aligned slots between the proximal and distal ends.

7. The foundation of claim 6 and wherein each leg of the plurality of legs further comprise a first mounting bracket positioned within the first pair of aligned slots, the first mounting bracket having a plurality of apertures that are configured for attaching the first mounting bracket to the central hub.

8. The foundation of claim 6 and wherein each leg of the plurality of legs further comprise a second mounting bracket positioned within the second pair of aligned slots, the second mounting bracket having a plurality of apertures that are configured for attaching the second mounting bracket to adjacent floor panels proximate a distal leg end thereof.

9. The foundation of claim 6 and wherein each of the plurality of legs further comprise a third mounting bracket positioned within the third pair of aligned slots, the third mounting bracket comprising:

an upper portion extending above the main member and having a plurality of apertures; and a lower portion extending below the main member, the lower portion having a plurality of apertures.

10. The foundation of claim 6 and further comprising a plurality of substantially horizontal connecting member configured to interconnect adjacent legs of the plurality and also configured to form a substantially concentric ring relative to the hub.

11. The foundation of claim 1 and wherein each leg of the plurality of legs further comprises an intermediate brace having a first end configured to be removably connected to the main member between the proximal leg end and the distal leg end and a second end configured to be removably connected to a wall panel of the plurality of wall panels.

12. A monopole structure comprising:

a monopole having a proximal end for attaching to a foundation and a distal end for attaching a piece of equipment thereto;

a foundation comprising:

a central hub;

a plurality of legs, each leg of the plurality of legs is configured to be removably attached to the hub at a proximal leg end thereof and having a distal leg end;

a plurality floor panels, each panel of the plurality of panels having a proximal panel end and a distal panel end, the proximal panel end of each of the plurality of floor panels is configured to be removably attached to the central hub and each of the distal panel ends is configured to be attached to a legs of the plurality of legs such that a substantially continuous floor is formed from a perimeter of the central hub that extends radially outwardly from the central hub, wherein the substantially continuous floor is configured to accept native soil as ballast; and a lifting mechanism attached to the foundation and the monopole for raising and lowering the monopole wherein the lifting mechanism comprises a jack, a hydraulic ram or a winch.

13. The foundation of claim 12 and wherein the hub further comprises:

a section of pipe having an outer surface, a first end, a second end and a central axis passing through the first end and the second end; and a plurality of ribs attached to the pipe at substantially even intervals about the outer surface of the pipe and wherein the proximal leg end of each leg of the plurality of legs is configured to be removably attached to two adjacent ribs.

14. The foundation of claim 13 and wherein the hub further comprises:

an upper flange attached to the first end of the pipe wherein the upper flange comprises a plurality apertures about the flange substantially uniformly spaced apart; and a lower plate attached to the second end of the pipe wherein the lower plate is attached to each rib of the plurality of ribs.

15. The foundation of claim 14 and wherein each of the plurality of legs comprises:

a main member having a proximal end and a distal end wherein the proximal end is configured to be removably attached to the upper flange and the distal end is configured to be removably attached to adjacent floor panels of the plurality of panels proximate a distal ends thereof; and a slanted support brace having a proximal end and a distal end wherein the proximal end is configured to be removably attached to one of the ribs and the distal end is configured to be removably to the main member between the proximal end and the distal end.

16. The foundation of claim 15 and wherein the main member comprises:

a pipe having an interior cavity extending from the proximal end to the distal end;

a first pair of aligned slots proximate the proximate the proximal end;

a second pair of aligned slots proximate the distal end; and a third pair of aligned slots between the proximal and distal ends.

17. The foundation of claim 16 and wherein the main member further comprises:

a first mounting bracket positioned within the first pair of aligned slots, the first mounting bracket having a plurality of apertures that are configured for attaching the first mounting bracket to the central hub;

a second mounting bracket positioned within the second pair of aligned slots, the second mounting bracket having a plurality of apertures that are configured for attaching the second mounting bracket to adjacent floor panels proximate a distal end thereof; and a third mounting bracket positioned within the third pair of aligned slots, the third mounting bracket comprising:

an upper portion extending above the main member and having a plurality of apertures; and a lower portion extending below the main member, the lower portion having a plurality of apertures.

18. The foundation of claim 12 and further comprising a plurality of substantially horizontal connecting member configured to interconnect with adjacent legs and also adapted to form a substantially concentric ring relative to the hub.

19. The foundation of claim 12 and further comprising a plurality of wall panels configured to engage the plurality of leg proximate the distal leg end and the plurality of floor panels proximate the distal panel end, wherein the plurality of wall panels are configured to form a substantially continuous wall concentric with the central hub.

20. The foundation of claim 12 and further comprising:

a plurality of first brace members configured to be removably connected to one wall panel of the plurality of wall panels between a top edge and a bottom edge thereof with the plurality of legs; and a plurality of second brace members configured to be removably connected to the plurality of a wall panel of the plurality of wall panel proximate a top edge thereof with the plurality of legs.

* * * * *